US006705548B2

(12) United States Patent
Bendig et al.

(10) Patent No.: US 6,705,548 B2
(45) Date of Patent: Mar. 16, 2004

(54) NOZZLE FOR SPRAYING A SURFACE AND METHOD OF SPRAYING

(75) Inventors: Lothar Bendig, Pfullingen (DE); Hermann Lange, Metzingen (DE)

(73) Assignee: Lechler GmbH & Co. KG, Metzingen (DE)

( * ) Notice: Subject to any disclaimer, the term of this patent is extended or adjusted under 35 U.S.C. 154(b) by 310 days.

(21) Appl. No.: 09/900,445

(22) Filed: Jul. 9, 2001

(65) Prior Publication Data

US 2002/0020764 A1 Feb. 21, 2002

(30) Foreign Application Priority Data

Jul. 7, 2000 (DE) ..... 100 33 190
Aug. 22, 2000 (DE) ..... 100 41 120

(51) Int. Cl.[7] ..... B05B 1/26

(52) U.S. Cl. ..... 239/506; 239/200; 239/202; 239/203; 239/204; 239/205; 239/505; 239/514; 239/516; 239/523; 239/524

(58) Field of Search ..... 239/200, 202, 239/203, 204, 205, 505, 506, 514, 516, 518, 523, 524, 569

(56) References Cited

U.S. PATENT DOCUMENTS 1,899,711 A * 2/1933 Munz ..... 239/204
4,471,908 A * 9/1984 Hunter ..... 239/205
4,986,474 A * 1/1991 Schisler et al. ..... 239/205
5,845,849 A * 12/1998 Mitzlaff ..... 239/203

* cited by examiner

*Primary Examiner*—Robin O. Evans
(74) *Attorney, Agent, or Firm*—Crowell & Moring LLP

(57) ABSTRACT

A nozzle for spraying surfaces is equipped with a piston rod centrally arranged in a feeding duct. The piston rod has an impact plate which is held by a spring in a position aligned with the surface to be sprayed. As a result of liquid pressure, the impact plate arrives in a second end position at a distance from the surface to be sprayed in which. As a result of a ring gap on an input side around the piston rod, the impact plate becomes a deflecting part for the spraying liquid exiting in a ring shape, which, in a circular spraying cone directed at a flat angle with respect to the surface to be sprayed, is then emitted onto the surface to be sprayed.

20 Claims, 2 Drawing Sheets

NOZZLE FOR SPRAYING A SURFACE AND METHOD OF SPRAYING

BACKGROUND AND SUMMARY OF THE INVENTION

This application claims the priorities of German application 100 33 190.4, filed Jul. 7, 2000 and German application 100 41 120.7, filed Aug. 22, 2000, the disclosures of which are expressly incorporated by reference herein.

The invention relates to a nozzle for spraying a surface, having a housing with a feeding duct and with an outlet opening for the liquid to be sprayed, as well as having an impact plate for deflecting the jet emerging from the outlet opening.

Spraying nozzles of this type are known, in the case of which, for example, a liquid jet impacts on an impact plate arranged at a distance in front of the outlet opening and is distributed from there in the shape of a fan as a spray jet to the outside. When surfaces are to be cooled, such spraying nozzles are correspondingly arranged at a distance in front of the surface on a holding device. Other devices for cooling surfaces also provide spraying nozzles which are arranged at a distance from the surface and emit, for example, a conical spraying jet in the downward direction onto the surface. In all cases, it is necessary to fasten the spraying nozzles at a corresponding distance in front of the surface to be cooled on a holding device. The necessary distance of the nozzles becomes the larger, the larger the surface to be acted upon. In the case of such constructions, it is always necessary to lay, in addition to the holding devices for the nozzles, also the corresponding piping for feeding the corresponding cooling liquid.

It is an object of the present invention to further develop a nozzle of the initially mentioned type such that a holding device outside the surface and thus also the piping to be laid outside the surface become superfluous.

In the case of a nozzle of the initially mentioned type, preferred embodiments of the invention provides that the outlet opening is situated in the surface to be sprayed and the impact plate is arranged on a piston rod centrally guided in the feeding duct and closes off the outlet opening in one of its end positions, that the impact plate can be adjusted against the force of a restoring spring by the pressure of the liquid into a second end position defined by a stop, and in that, in this second end position, the impact plate is situated at a distance in front of the outlet opening.

As a result of this embodiment, the arrangement of a holding device outside the surface to be sprayed will be superfluous because the surface itself is used for accommodating the nozzle. The feed pipes required for the nozzle can be laid on the side facing away from the surface to be sprayed.

As a further development of preferred embodiments of the invention, the piston rod can penetrate a passage opening of a smaller cross-section than the outlet opening, which passage opening is situated in front of the outlet opening in the flow direction of the liquid, so that the liquid to be sprayed is guided to the outside essentially in the area along the piston rod and is then deflected on the impact plate. In this case, the impact plate can, on its side facing the outlet opening, extend at least in the radially exterior area in a plane perpendicular to the axis of the piston rod, and a rounding can be provided in the transition area between the piston rod and the impact plate, which rounding contributes to the fact that the liquid emerging from the nozzle is guided along the piston rod, is then continuously deflected into a direction extending perpendicular to the original outlet direction and is then deflected again to the surface to be sprayed as a backward-directed spray fan.

As a further development of preferred embodiments of the invention, the stop defining the second end position of the impact plate can be formed by a piston at the end of the piston rod facing away from the impact plate, which piston can be displaced in a guiding cylinder of a predetermined length. This guiding cylinder and the piston guided therein determine the distance of the impact plate from the surface to be sprayed. The piston itself has the purpose of pressing the piston rod as a result of the liquid pressure to the outside so that the impact plate takes up its second end position.

However, the piston can also be used as a resting device for a helical spring which is used as a restoring spring and is arranged around the piston rod and whose second end rests against a guide disk within the feeding duct, which guide disk is used as a guide for the piston rod. In this case, the piston and the guide disk are preferably provided with passage openings for the liquid to be sprayed.

As a further development of preferred embodiments of the invention, the housing can be provided with a flange whose side pointing away from the housing is aligned with the impact plate in its inoperative position. This flange can be inserted in such a manner into the surface to be sprayed that its exterior side aligned with the impact plate coincides with the surface to be sprayed.

Other objects, advantages and novel features of the present invention will become apparent from the following detailed description of the invention when considered in conjunction with the accompanying drawings.

DETAILED DESCRIPTION OF THE DRAWINGS

Figure 1:
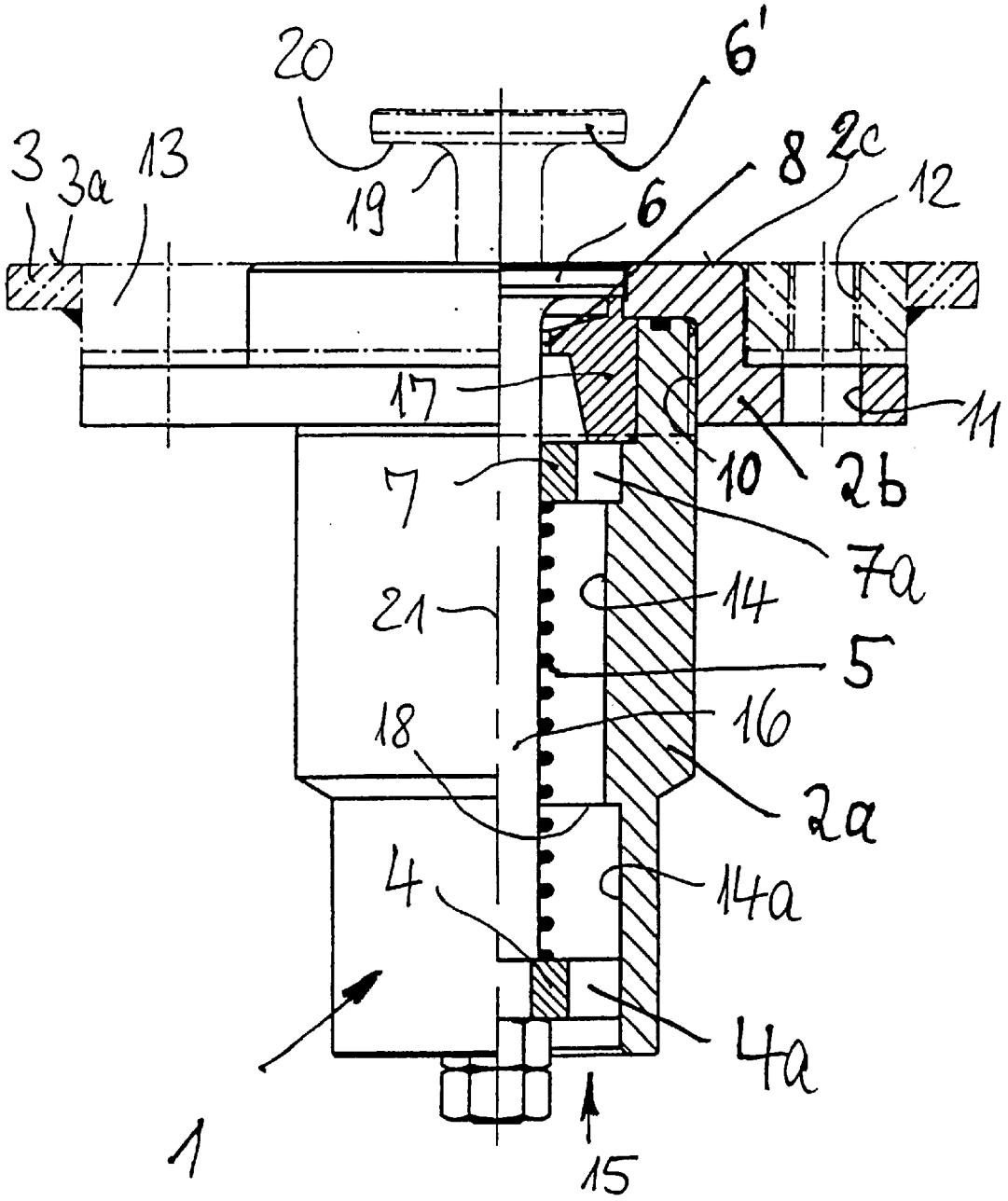
FIG. 1 is a partially sectional lateral view of a nozzle constructed according to a preferred embodiment of the invention.

The nozzle 1 according to FIG. 1, which can also be called a deflector nozzle, comprises a housing 2*a* with a flange 2*b* screwed to the housing 2*a* by way of a thread 10, which flange 2*b* is provided with openings 11 distributed along its circumference and can be screwed into corresponding receiving bores 12 by way of screws which are not shown. The receiving bores 12 are, for example, provided on a ring 13 which is arranged in an opening of a wall 3 whose exterior side is to be sprayed for cooling purposes.

The housing 2*a* is provided with an offset cylindrical feeding duct 14 for the liquid to be sprayed which, in a manner not shown in detail, is fed from the connection part of the housing 2*a* in the direction of the arrow 15. In a section 14*a* of the feeding duct 14 having a larger diameter, a piston 4 is arranged which is fixedly mounted at the lower end of the piston rod 16. The piston 4 is provided with passage openings 4*a* for the flowing-through of liquid and is used as a stop for a helical spring 5 which is placed around the piston rod 16 and rests with its other end against a guide disk 7 which is fixedly arranged in the housing 2*a* and is also provided with passage openings 7*a* for the liquid to be sprayed. In this case, the guide disk 7 is held in the housing 2*a* by means of an insert 17 which surrounds the piston rod 16 with a ring gap 8, which piston rod 16 is provided with an impact plate 6 outside the insert 17. The impact plate 6 rests on the insert 17 in the position illustrated by a solid line and closes an outlet opening ending on the outside with the surface 2*c* of the flange 2*b*. This top side 2*c* of the flange, as illustrated in FIG. 1, is situated in a plane with the exterior side 3*a* of the wall 3 which, in turn, represents the surface to be sprayed for cooling purposes.

Figure 2:
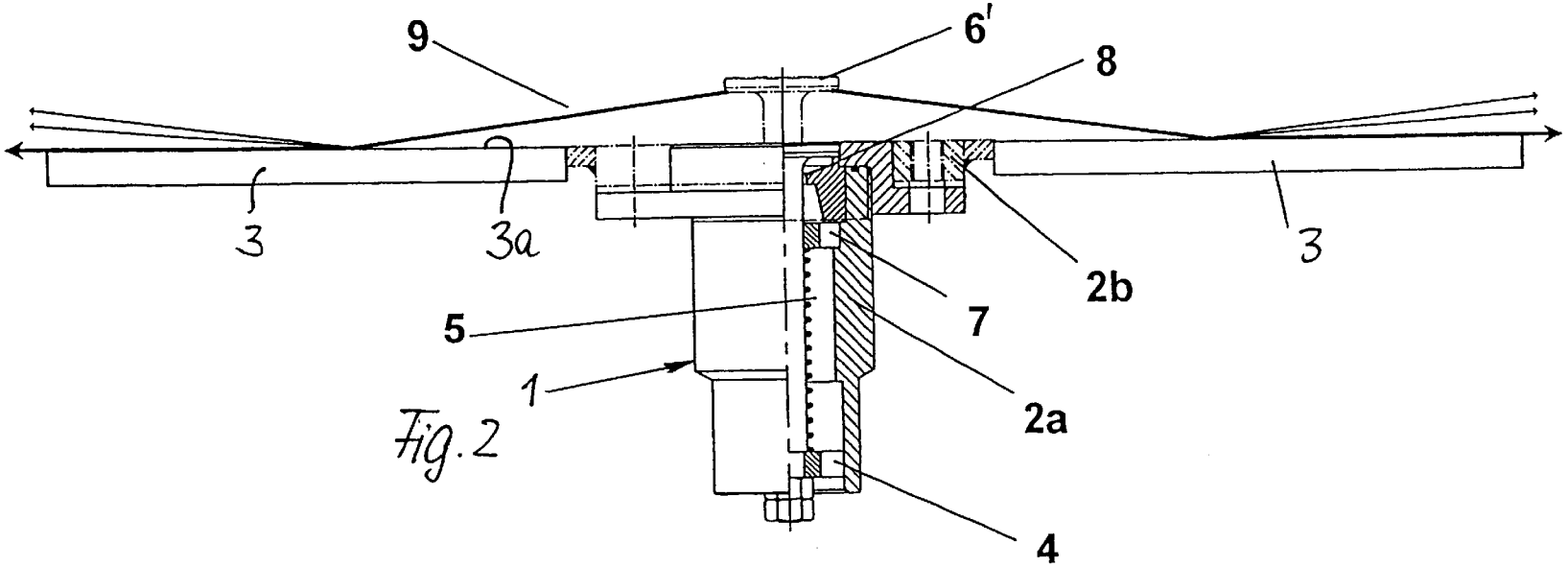
FIG. 2 is a view of the nozzle according to FIG. 1 shown, after its installation into the surface to the sprayed.
Figure 3:
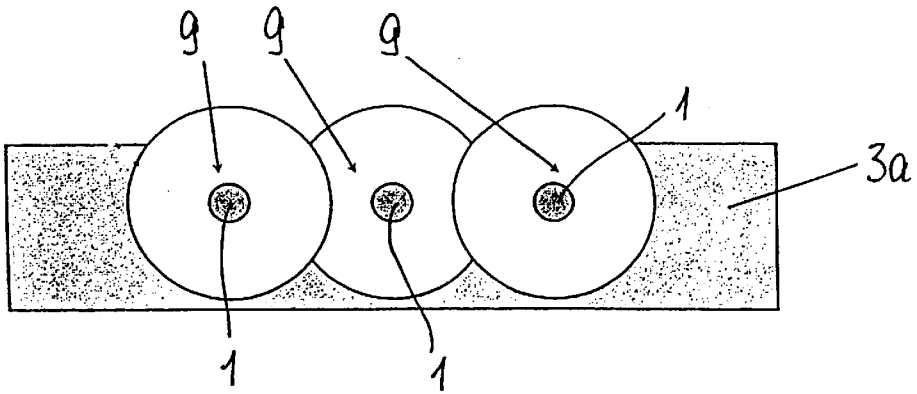
FIG. 3 is a reduced schematic top view of the arrangement according to FIG. 2; however, three of the spraying nozzles according to the invention being arranged side-by-side and the overlapping of the mutual spraying ranges being illustrated.

The function of the nozzle is illustrated by means of FIG. 2. It is shown that, when the supply of liquid is released in the direction of the arrow 15, the piston 4 is pressed upward against the effect of the spring 5 until it strikes against the edge 18 of the cylindrical guiding area 14*a*. In this position, the impact plate takes up the position 6' in which, as illustrated by a dash-dotted line, the piston rod 16 is displaced in the upward direction. The liquid therefore exits through the ring gap 8 under pressure, is guided upward on the exterior surfaces of the piston rod 16, and is deflected to the outside by way of the rounding 19 between the surface 20 extending perpendicular to the axis 21 of the piston rod 16 on the underside of the impact plate 6, 6' in order to, as illustrated in FIG. 2, be sprayed in a flat spray fan 9, whose reflection angle deviates only slightly from the horizontal line, in a large-surface manner to the outside approximately in the shape of a circle. FIG. 3 illustrates that, when several nozzles 1 are arranged on the surface 3*a*, these relatively large spray fans 9 can mutually overlap, so that a surface-covering spraying can be achieved.

If the liquid pressure is switched off, the piston 4 is restored by way of the spring 5 into the starting position illustrated in FIG. 1, in which the impact plate is aligned with the surface 3*a* to be sprayed. The spring force is to be dimensioned such that the applied water pressure can overcome this spring force.

One usage possibility for the nozzle according to the invention is the spraying of side walls of ships for the purpose of cooling them in order to then make them invisible to infrared detection devices. Naturally, the nozzle can also always be used in situations when surfaces are to be sprayed and major superstructures for holding and supplying the nozzle are not desirable outside the surface.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Nozzle for spraying a surface, having a housing with a feeding duct and with an outlet opening for the liquid to be sprayed, as well as having an impact plate for deflecting the jet emerging from the outlet opening, wherein the outlet opening is situated in a surface to be sprayed, and the impact plate is arranged on a piston rod centrally guided in the feeding duct and closing off the outlet opening in a first of its end positions, wherein the impact plate can be adjusted against the force of a restoring spring by pressure of liquid into a second end position defined by a stop, wherein the impact plate is situated in this second end position at a distance in front of the outlet opening, and wherein on its side facing the outlet opening, the impact plate extends at least in a radially exterior area in a plane perpendicular to an axis of the piston rod.

2. Nozzle according to claim 1, wherein the piston rod penetrates a ring gap situated in front of the outlet opening.

3. Nozzle according to claim 1, wherein the liquid is a cooling liquid for cooling the surface.

4. Nozzle according to claim 1, wherein the housing is provided with a flange whose side pointing away from the housing is aligned with the impact plate when in its inoperative first position.

5. Nozzle according to claim 1, wherein a rounding is provided in a transition area between the piston rod and the impact plate.

6. Nozzle according to claim 4, wherein the flange is inserted into the surface to be sprayed in such a manner that its exterior side aligned with the impact plate is also aligned with the surface.

7. Nozzle according to claim 1, wherein the stop is formed by a piston which is arranged at an end of the piston rod facing away from the impact plate, said piston being displaceable in a guiding cylinder of a predetermined length.

8. Nozzle according to claim 7, wherein the piston is used as a resting device for an end of a helical spring serving as a restoring spring and arranged around the piston rod.

9. Nozzle according to claim 8, wherein a second end of the helical spring rests against a guide disk inside the feeding duct, which guide disk is used as a guide for the piston rod.

10. Nozzle according to claim 7, wherein the piston and the guide disk are provided with passage openings for the liquid to be sprayed.

11. Nozzle according to claim 8, wherein the piston and the guide disk are provided with passage openings for the liquid to be sprayed.

12. Nozzle according to claim 9, wherein the piston and the guide disk are provided with passage openings for the liquid to be sprayed.

13. Method of cooling a surface utilizing a nozzle comprising:

a nozzle housing having a liquid inlet and a liquid outlet, and an impact plate supported on a piston rod of a piston disposed in the nozzle housing for movement between a first position where said impact plate forms a part of the surface and a second position where said impact plate is spaced from the surface and forms a deflection plate for deflecting liquid from the liquid outlet back onto the surface, said method comprising applying liquid under pressure to said inlet to thereby force said piston from said first position to said second position and to impact said liquid against the impact plate, wherein said surface is a vertical surface and the nozzle is installed in the vertical surface.

14. Nozzle for spraying a surface, having a housing with a feeding duct and with an outlet opening for the liquid to be sprayed, as well as having an impact plate for deflecting the jet emerging from the outlet opening, wherein the outlet opening is situated in a surface to be sprayed, and the impact plate is arranged on a piston rod centrally guided in the feeding duct and closing off the outlet opening in a first of its end positions, wherein the impact plate can be adjusted against the force of a restoring spring by pressure of liquid into a second end position defined by a stop, wherein the impact plate is situated in this second end position at a distance in front of the outlet opening, and wherein the nozzle is installed in a vertical surface and is operable to spray the liquid uniformly on the vertical surface.

15. A method of cooling a surface utilizing a nozzle comprising:

a nozzle housing having a liquid inlet and a liquid outlet, and an impact plate supported on a piston rod of a piston disposed in the nozzle housing for movement between a first position where said impact plate forms a part of the surface and a second position where said impact plate is spaced from the surface and forms a deflection plate for deflecting liquid from the liquid outlet back onto the surface, said method comprising applying cooling liquid under pressure to said inlet to thereby force said piston from said first position to said second position and to impact said cooling liquid against the impact plate, wherein said surface is on a wall of a ship and wherein a plurality of said nozzles are supplies with cooling liquid to cool said surface.

16. Nozzle for spraying a surface, having a housing with a feeding duct and with an outlet opening for the liquid to be sprayed, as well as having an impact plate for deflecting the jet emerging from the outlet opening, wherein the outlet opening is situated in a surface to be sprayed, and the impact plate is arranged on a piston rod centrally guided in the feeding duct and closing off the outlet opening in a first of its end positions, wherein the impact plate can be adjusted against the force of a restoring spring by pressure of liquid into a second end position defined by a stop, wherein the impact plate is situated in this second end position at a distance in front of the outlet opening, wherein the liquid is a cooling liquid for cooling the surface, and wherein the nozzle is installed in a ship sidewall and is operable to selectively cool the ship side wall by spraying the liquid to make the ship side wall invisible to infrared detection devices.

17. An assembly comprising a nozzle operable to spray liquid on a surface, said nozzle comprising:

a nozzle housing having a liquid inlet and a liquid outlet, and an impact plate supported on a piston rod of a piston disposed in the nozzle housing for movement between a first position where said impact plate forms a part of the surface and a second position where said impact plate is spaced from the surface and forms a deflection plate for deflecting liquid from the liquid outlet back onto the surface.

18. An assembly according to claim 17, wherein said piston is disposed to be acted on by said liquid to move from said first to said second position.

19. An assembly according to claim 18, comprising a biasing spring acting on said piston as a direction forward the first position.

20. A method of cooling a surface utilizing a nozzle comprising:

a nozzle housing having a liquid inlet and a liquid outlet, and an impact plate supported on a piston rod of a piston disposed in the nozzle housing for movement between a first position where said impact plate forms a part of the surface and a second position where said impact plate is spaced from the surface and forms a deflection plate for deflecting liquid from the liquid outlet back onto the surface, and extends on its side facing the outlet opening at least in a radially exterior area in a plane perpendicular to an axis of the piston rod, said method comprising applying cooling liquid under pressure to said inlet to thereby force said piston from said first position to said second position and to impact said cooling liquid against the impact plate.

* * * * *